US011251008B2

(12) United States Patent
Kanapady et al.

(10) Patent No.: US 11,251,008 B2
(45) Date of Patent: Feb. 15, 2022

(54) HIGH VOLTAGE CARTRIDGE FUSE ASSEMBLY

(71) Applicant: EATON INTELLIGENT POWER LIMITED, Dublin (IE)

(72) Inventors: Ramdev Kanapady, Campbell, CA (US); Xavier Ching, Oakland, CA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/321,970

(22) Filed: May 17, 2021

(65) Prior Publication Data

US 2021/0375570 A1 Dec. 2, 2021

Related U.S. Application Data

(60) Provisional application No. 63/032,928, filed on Jun. 1, 2020.

(51) Int. Cl.

| | |
|---|---|
| ***H01H 85/08*** | (2006.01) |
| ***H01H 85/10*** | (2006.01) |
| ***H01H 85/041*** | (2006.01) |
| *H01H 85/175* | (2006.01) |
| *H01H 85/06* | (2006.01) |

(52) U.S. Cl.
CPC ..... *H01H 85/10* (2013.01); *H01H 85/0415* (2013.01); *H01H 85/06* (2013.01); *H01H 85/08* (2013.01); *H01H 85/175* (2013.01)

(58) Field of Classification Search
CPC .. H01H 85/0415; H01H 85/042; H01H 85/06; H01H 85/08; H01H 85/10; H01H 85/175
See application file for complete search history.

(56) References Cited

U.S. PATENT DOCUMENTS 3,261,952 A * 7/1966 Kozacka ..... H01H 85/10 337/159
3,479,630 A * 11/1969 Kozacka ..... H01H 85/042 337/159
3,935,553 A * 1/1976 Kozacka ..... H01H 85/0456 337/159
4,204,183 A * 5/1980 Blewitt ..... H01H 69/02 337/159

(Continued)

OTHER PUBLICATIONS

Bahman, A. et al.; Fuse Modeling for Reliability Study of Power Electronic Circuits; Proceedings of the 2017 IEEE Applied Power Electronics Conference and Exposition (APEC); Aalborg University—Denmark; 9 pages.

*Primary Examiner* — Jacob R Crum
(74) *Attorney, Agent, or Firm* — Armstrong Teasdale LLP

(57) ABSTRACT

An electrical cartridge fuse including a cylindrical housing, first and second terminals coupled to the cylindrical housing, and a fuse element inside the housing and interconnected between the first and second terminals. The fuse element has a main body having at least five openings formed therein in a single line along a longitudinal axis of the fuse element, a guide element formed on a first end of the main body, and a hanger element formed on the second end of the main body. The cartridge fuse has a package size of about 6×32 mm and a voltage rating of at least 500 VADC, a 20 kA IR Rating, a current rating of 12 A to 30 A and a defined opening time at 100% rated current.

20 Claims, 5 Drawing Sheets

(56) References Cited

U.S. PATENT DOCUMENTS

| | | | | |
|---|---|---|---|---|
| 5,252,942 | A * | 10/1993 | Gurevich | H01H 85/055<br>337/163 |
| 2016/0268089 | A1* | 9/2016 | Schlaak | H01H 85/185 |
| 2018/0061607 | A1* | 3/2018 | Schlaak | H01H 85/157 |
| 2018/0204700 | A1* | 7/2018 | Brosas | H01H 69/02 |
| 2019/0214214 | A1* | 7/2019 | Lasini | H01H 85/60 |
| 2020/0090893 | A1* | 3/2020 | Leung | H01H 85/175 |

* cited by examiner

HIGH VOLTAGE CARTRIDGE FUSE ASSEMBLY

CROSS REFERENCE TO RELATED APPLICATIONS

This application claims the benefit of U.S. Provisional Application Ser. No. 63/032,928 filed Jun. 1, 2020, the entire disclosure of which is hereby incorporated by reference in its entirety.

BACKGROUND OF THE INVENTION

The field of the invention relates generally to electrical circuit protection fuses, and more particularly to high voltage 6×32 mm cartridge fuse assemblies.

Fuses are widely used as overcurrent protection devices to prevent costly damage to electrical circuits. Fuse terminals typically form an electrical connection between an electrical power source or power supply and an electrical component or a combination of components arranged in an electrical circuit. One or more fusible links or elements, or a fuse element assembly, is connected between the fuse terminals, so that when electrical current flow through the fuse exceeds a predetermined limit, the fusible elements melt and open one or more circuits through the fuse to prevent electrical component damage.

So-called cartridge fuses include a cylindrical housing and end caps or ferrules attached to the cylindrical housing with a fuse element connected therebetween. Such cartridge fuses have a small package size compared to other types of fuses having comparable high voltage ratings. In view of constantly expanding variations of electrical power systems, however, known cartridge fuses are disadvantaged in some aspects. Specifically, improvements are desired in view of higher current, higher power DC operating systems such as those found in electric vehicles and uninterruptible power supply systems, for example, which impose demands that known cartridge fuses either cannot meet in the desired package size or cannot meet in a cost effective manner.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

Figure 1:
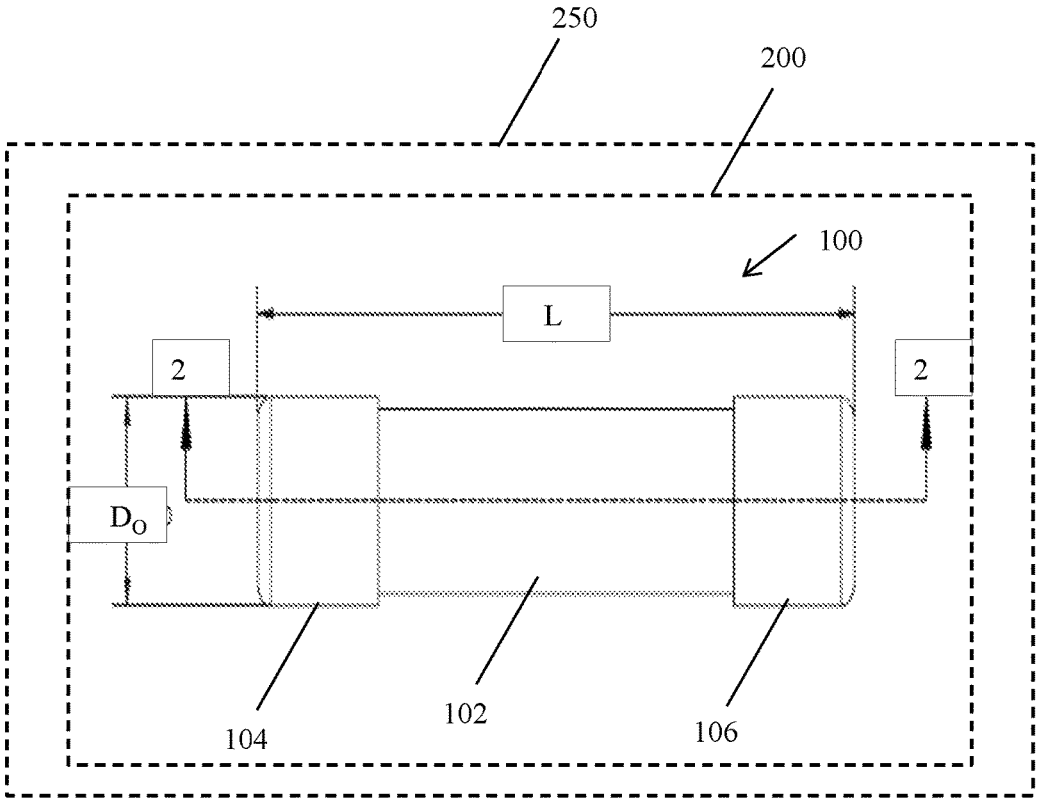
FIG. 1 is a side view of an exemplary high voltage cartridge fuse assembly according to a first embodiment of the present invention.

Recent advancements in electric vehicle technologies, among other things, present unique challenges to fuse manufacturers. More specifically, electric vehicle (EV) manufacturers are seeking fusible circuit protection for electrical power distribution systems operating at voltages much higher than conventional electrical power distribution systems for vehicles, yet at the same time are seeking smaller and lighter fuses to protect the power system in the EV. Relatively smaller cartridge fuses for use with such higher voltage, direct current (DC) power systems of an EV are therefore desired, but known cartridge fuses are subject to certain limitations that have so far prevented them from fully meeting the needs of the marketplace.

Electrical power systems for state of the art EVs may operate at voltages as high as 450 VDC. The increased power system voltage desirably delivers more power to the EV per battery charge. Operating conditions of electrical fuses in such high voltage power systems is much more severe, however, than lower voltage systems. Specifically, specifications relating to electrical arcing conditions as the fuse opens can be particularly difficult to meet for higher voltage power systems, especially so for relatively small fuses such as a cartridge fuses that would be desirably used to protect certain loads in the power system.

Cartridge fuses are presently available having high voltage ratings that could potentially be used in an EV power system to protect desired loads with a relatively small package size compared to other types of fuses. The smaller package size, sometimes referred to as a footprint of the fuse in the physical power system, translates to a reduction in the size of the power system in the EV, as well as reduction in weight. For example, cylindrical, high voltage power fuses with voltage ratings of 600 VAC and 500 VDC and greater are known that have a relatively larger package size that is, for example, several inches or more in length and an inch and half or more in diameter. Cartridge fuses are known having voltage ratings of 600 VAC and 500 VDC in a significantly smaller and lighter package size of 10×38 mm (i.e., about 0.4 inches in diameter and about 1.5 inches in length). Still further package size reduction is desired for EV power systems, however, and while smaller cartridge fuses are known having a package size of about 6×32 mm (about ¼ inch in diameter by 1 and ¼ inch length) with voltage ratings of 500 VAC/VDC they do not offer performance capability needed for the EV application.

For instance, certain known 6×32 mm cartridge fuses are available in a relatively limited set of amperage ratings. The higher DC current in EV power systems (e.g., 12 A or higher) is, however, above the available DC current ratings (e.g., 5 A or less) that the 6×32 cartridge fuse can handle, and as such nuisance operation of such a fuse would result in an EV power system that is inherently undesirable. Other 6×32 mm cartridge fuses are known that have higher DC current ratings (e.g., 12 A to 30 A), but they have lower interruption ratings (e.g., 10 kA) than needed in an EV application (e.g., 20 Ka). As such, the need to carry higher current is in some tension with the need to increase the interruption rating. Known cartridge fuses can satisfy one or the other, but not both of these parameters.

With further regard to the breaking capacity or interrupting rating (IR) of a 6×32 cartridge fuse, effectively managing the increased arc energy in the opening/interruption of higher current DC power systems within the smaller package size of a cartridge fuse is difficult, and conventional 6×32 mm cartridge fuses are generally unable to safely and reliably do so. The conventional approach to increase the IR of the fuse would be to expand its footprint to accommodate the increased arc energy in a larger space of, for example, a 10×38 mm package size instead of the initial 6×32 mm package size, but as mentioned above adoption of the larger package size is counterproductive to the aim of EV power systems to become smaller and lighter and in view of the same expanding the package size of the fuse is not an acceptable solution.

Also, in known 6×32 mm cartridge fuses an opening time for 100% of rated current cannot be reliably determined and opening time is therefore typically undefined by fuse manufacturers. In many cases outside the EV realm, power systems normally operate at a current that is 75% or less of the rated current for the fuse so the lack of a defined opening time at 100% of rated current is not consequential to the power system being protected. In an EV power system, however, where 100% of rated current can be expected in the normal operation of the EV power system the fuse opening time at 100% rated current is a key consideration in the reliable operation of the EV power system. Small cartridge fuses having an unreliable opening time at 100% rated current, or perhaps that may not open at all under 100% rated current, therefore are not acceptable for use in the EV power system.

Meeting the desired higher DC current ratings and high interrupting rating while maintaining the relatively small package size of a 6×32 mm cartridge fuse therefore raises a number of technical considerations that must be identified, balanced, and reconciled in order meet the needs of the marketplace. To date, an effective and economical solution to such needs has not been delivered to meet the unfilled needs of state-of-the-art power systems in applications such as EV's.

Exemplary embodiments of inventive 6×32 mm cartridge fuses are described herein that advantageously overcome the aforementioned problems and limitations above and provide an effective 6×32 mm cartridge fuse solution for EV applications. Specifically, 6×32 mm cartridge fuses are described having a voltage rating of 500 VDAC (i.e., 500 VAC or 500 VDC), 20 kA IR Rating, 12 A to 30 A current ratings and a defined opening time at 100% rated current. Such 6×32 mm cartridge fuses are realized via improved fuse elements shaped and designed to balance the considerations above and deliver the desired performance that heretofore has not been realized in cartridge fuses of similar size.

The inventive 6×32 mm cartridge fuses may be manufactured with desired performance characteristics in a cost-effective manner that is compatible with existing automated manufacturing equipment and processes. Compatibility with existing equipment and processes drives significant cost reduction in introducing higher performing cartridge fuses in the same or smaller package size of conventional fuses. Custom fabrication of tooling equipment and expense that may otherwise be required by alternative solutions that are not compatible with existing manufacturing equipment and processes is therefore avoided.

While described in the context of EV power systems posing particular issues, other power systems or applications imposing similar demands including but not necessarily limited to uninterruptible power supplies and related power systems would benefit from the inventive 6×32 mm cartridge fuses described herein. The EV application is therefore described for the sake of illustration rather than limitation. Also, method fabrication aspects of manufacturing the fuse will be in part apparent and in part explicitly described in relation to the exemplary embodiments shown in the Figures and described next.

Figure 2:
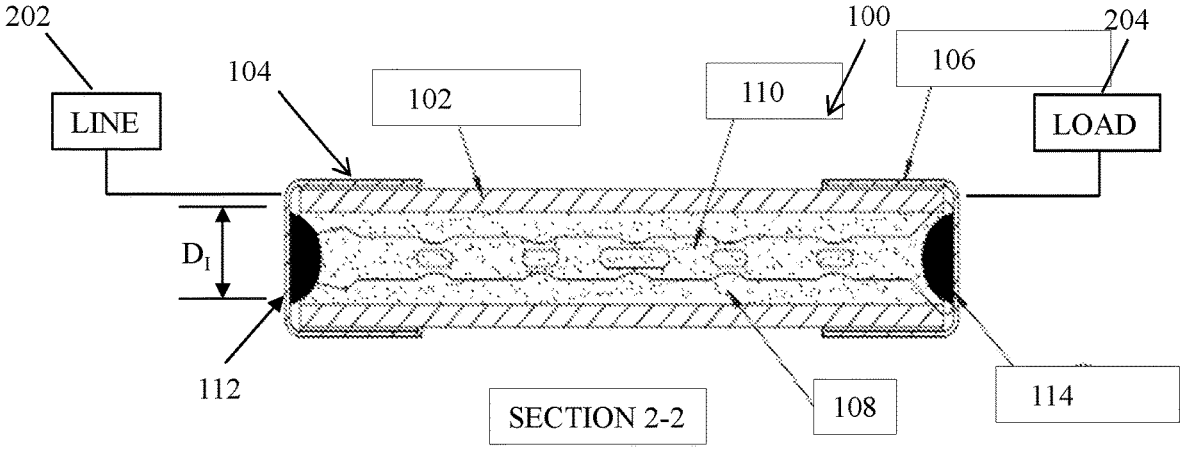
FIG. 2 is a cross-sectional view of the high voltage cartridge fuse assembly shown in FIG. 1.

FIGS. 1 and 2 are a respective side view and cross-sectional view of an exemplary cartridge fuse assembly 100 according to a first embodiment of the present invention. The cartridge fuse assembly 100 includes a cylindrical or tubular housing 102, and terminals 104 and 106 in the form of end caps or ferrules attached to each end of the housing 102 for line and load-side connection to an electrical power system 200. The electrical power system 200 in one example may be provided in an electric-powered vehicle 250 such as an all-battery electric vehicle (BEV), a hybrid electric vehicle (HEV) or a plug-in hybrid electric vehicle (PHEV) that presents one or more of the issues discussed above that separately and in combination present certainly incompatibilities with existing cartridge fuses but that are resolved by the cartridge fuse assembly 100 as further explained below.

Likewise, in another contemplated example, the power system 200 may be an uninterruptible power supply system that likewise presents one or more of the issues discussed above that separately and in combination render existing cartridge fuses incompatible for use with uninterruptible power supply systems. Of course, still other power systems that present similar issues may also benefit from the cartridge fuse assembly 100 that overcome such issues.

As shown in FIG. 1, the cartridge fuse assembly 100 has an outer diameter Do of about 6 mm and an overall axial length L of about 32 mm and therefore has the package size of a 6×32 mm fuse desired for certain applications such EVs and uninterruptible power supplies. The 6×32 mm package size of the cartridge fuse assembly 100 is specifically contrasted with larger 10×38 mm cartridge fuses and other fuse packages that are larger than 10×38 mm cartridge fuses. The 6×32 mm package size of the cartridge fuse assembly 100 beneficially meets size and weight reduction goals of EV manufacturers relative to larger package-sized fuse that can otherwise offer similar performance capabilities.

In a contemplated example, the housing 102 may be fabricated from ceramic having sufficient structural strength to contain arc energy inside the housing 102 as the fuse element therein (described further below) operates to open or interrupt the circuit being protected. As such, the ceramic housing is strong enough to contain the increased arc energy of an EV power system operating at 450 VDC, for example, without rupturing of the housing 102. In another embodiment, however, suitable materials other than ceramic are known which may be utilized to fabricate the housing 102 if desired to meet applicable power system requirements that do not require ceramic materials to meet.

In the cross-sectional view of FIG. 2, the cartridge fuse assembly 100 is further seen to include an arc quenching media 108 and a fuse element 110 that is mechanically and electrically connected to the end caps 104 and 106 via solder 112 and 114 at respective ends of the fuse element 110. As such, when the end cap 104 is connected to line-side circuitry 202 in the power system 200 and the end cap 106 is connected to load-side circuitry 204 in the power system 200 a current path is established from the line-side circuitry 202 to the end cap 104, through the solder 112 to the first end of the fuse element 110, through the fuse element 110 to its second end and to the solder 114, from the solder 114 to the end cap 106, and from the end cap 106 to the load-side circuitry 204. When the current flowing through the fuse element 110 reaches a predetermined magnitude for a predetermined time, the fuse element 110 physically melts and structurally fails, reaching a point where it no longer conducts current and therefore interrupts the current path through the fuse element 110 and opens the circuit path within the fuse 102 to isolate and protect the load-side circuitry 204 from damaging line-side currents. As the fuse element 110 melts, electrical arcing may occur, and arc energy may be dissipated in the arc-quenching media 108 that surrounds the fuse element 110 in the housing 102. The arc-quenching material 108 may be quartz silica sand in one embodiment or another known arc quenching media in an alternative embodiment.

Figure 3:
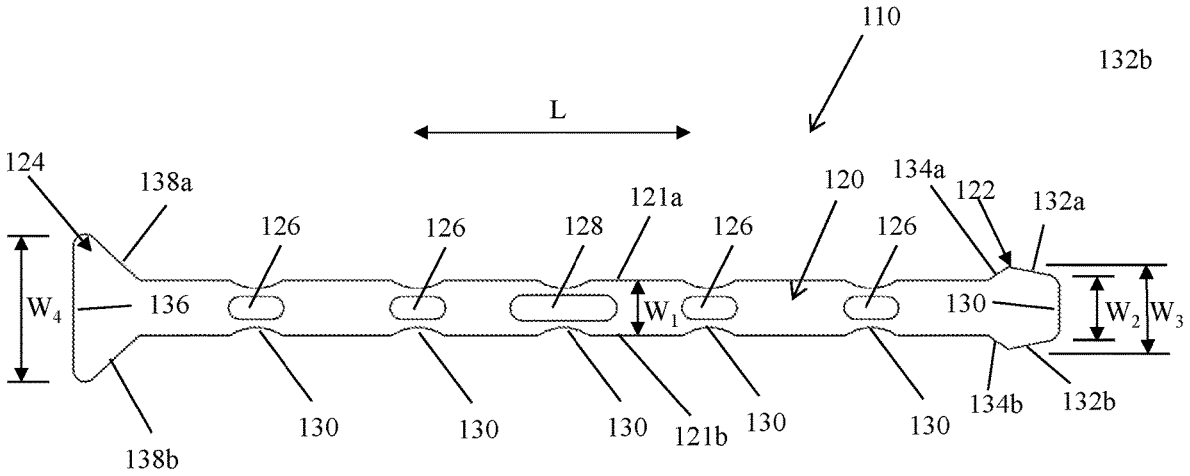
FIG. 3 is a top plan view of an exemplary fuse element for the high voltage cartridge fuse assembly shown in FIGS. 1 and 2.
Figure 4:
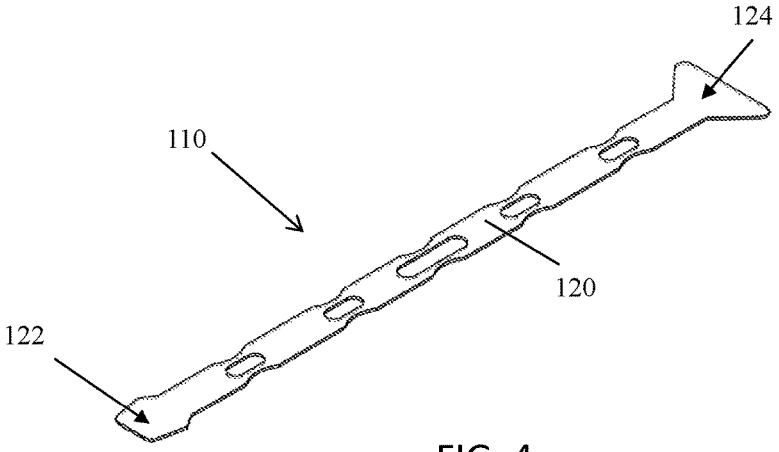
FIG. 4 is a perspective view of the fuse element shown in FIG. 3.

FIGS. 3 and 4 illustrate the fuse element 110 which in an exemplary embodiment is stamped from a thin strip of conductive material such as silver to include the features described below in an integrally formed and monolithic manner, although in other embodiment another conductive material such as copper may be used to fabricate the fuse element 110 of a similar structure. The fuse element 110 generally includes a main body 120 having an enlarged, tapered guide element 122 at one end and an enlarged hanger element 124 at its other end that each serve an assembly function in the assembly of the fuse 100 (FIGS. 1 and 2).

As seen in the plane of FIG. 3 the main body 120 of the fuse element has a first width $W_1$ measured between flat and parallel opposing side edges 121*a* and 121*b*. The opposing side edges 121*a*, 121*b* of the main body 120 further extend parallel to the axial length dimension L of the fuse element 110. As seen in FIG. 3, the axial length dimension L extends in a direction perpendicular to the width dimension $W_1$. The main body 120 is axially elongated such that its length in the dimension L is much larger than its width dimension, such that the main body 120 has a generally elongated rectangular profile. Also, in the length dimension L, the main body 120 is proportionally much larger than the tapered guide element 122 and the enlarged hanger element 124 that extend on either end of the main body 120. As such, the main body 120 of the fuse element 110 defines most of the overall axial length of the fuse element 120, while the tapered guide element 122 and the enlarged hanger element 124 define a small portion of the entire axial length of the fuse element 110.

The tapered guide element 122 on a first end of the main body 120 has a generally flat or straight end edge 130 with width $W_2$ at, relatively long and sloped opposing side edges 132*a*, 132*b* of increasing width extending away from the end edge 130 to a maximum width $W_3$ at a distance from the end edge 130. The opposing side edges 132*a*, 132*b* are in a mirror image relation to one another and have an equal but opposite slope to one another as shown. The tapered side edges 132*a*, 132*b* of the guide element 122 allow the fuse element 110 to be easily inserted into one end of the housing 102 without being precisely aligned.

The guide element 122 further includes relatively short and sloped side edges 134*a* and 134*b* reducing the width from the width $W_3$ back to the width $W_1$ of the main body 120 of the fuse element 110. The opposing side edges 134*a*, 134*b* are in a mirror image relation to one another and have an equal but opposite slope to one another as shown.

In the example shown in FIGS. 3 and 4, the width $W_2$ of the end edge 130 in the guide element 122 is slightly larger than the width $W_1$ of the main body 120, providing a slightly enlarged area for attachment to the end cap 104 via solder 112 (FIG. 2) in the assembly than the end of the main body 120 otherwise would provide. In the length dimension, however, the tapered side edges 132*a*, 132*b* are proportionally much longer than the tapered side edges 134*a*, 134*b*. As a result, the tapered side edges 132*a*, 132*b* define relatively long ramp surfaces extending away from the flat end edge 130 with a relatively shallow slope, while the tapered side edges 134*a*, 134*b* extend away from the tapered sections with a relatively steep slope returning to the width of the main body 120. In other words, the slope of the side edges 132*a*, 132*b* is much less than the slope of the side edges 134*a*, 134*b*.

As seen in FIG. 2, the maximum width $W_3$ of the guide element 122 is selected to be a bit less than the round inner diameter $D_1$ of the housing 102 and therefore the guide element beneficially serves to center the guide element 122 in the housing 102 during assembly of the fuse 100. Specifically, the sloped edges and larger width $W_3$ of the guide element 122 provides a limited tolerance at the distal end of the fuse element 110 for the fuse element 110 to extend at an angle relative to the longitudinal axis (i.e., the axial length direction) of the housing 102 as the fuse 102 is assembled. More specifically, the sloped edges and larger width $W_3$ of the guide element 122 will cause the guide element 122 to contact the round surface of inner diameter $D_1$ of the housing 102 and prevent it from being positioned at a further angular orientation inside the housing 102. The guide element 122 ensures that the fuse element 110 is therefore extended substantially straight through the housing 102 in a centered position with substantially uniform spacing from inner surface of the housing 102, which is important to contain the arcing energy in the operation of the fuse element 110 without rupturing of the housing 102 that may otherwise occur if the fuse element 110 were positioned too close to the inner surface of the housing 102.

The hanger element 124 that extends opposite the guide element 122 has a flat end edge 136 with a width $W_4$ that exceeds the inner diameter $D_1$ of the housing 102 (FIG. 2), and sloped, opposing side edges 138*a*, 138*b* extending away from the end edge 136 and reducing the width back to the smaller width $W_1$ that defines the main body 120 of the fuse element 110. The side edges 138*a*, 138*b* extend as mirror images to one another and therefore have an equal but opposite slope to one another. In the example shown, the slope of the side edges 138*a*, 138*b* is steeper than the slopes of the side edges in the guide element 122. The hanger element 124 has a triangular-like appearance on one end of the main body 120 whereas the guide element 122 has an appearance of a pentagonal-shaped head on the opposing end. The hanger element 124 further has rounded edges where the opposing side edges 138*a*, 138*b* meet the end edge 136.

The main body 120 of the fuse element 110 further includes a number of spaced apart openings located between the hanger element 122 and the guide element 124 and arranged in a single row (or in a single line) in the main body 120. The single row or single line of openings in the main body 120 is specifically contrasted with other possible fuse element configurations including multiple rows or multiple lines (instead of only one row or only one line) of openings in a wider fuse element. In the example shown, five in-line openings are provided including four smaller openings 126 arranged in pairs on each side of a larger opening 128. All of the openings 126, 128 are centered in the fuse element 110 in the widthwise dimension of the fuse element 100. That is, a longitudinal centerline of the in-line openings 126, 128 is located equidistant from the side edges 121*a*, 121*b* of the main body 120 and therefor coincides with an axial centerline of the main body 120.

Each of the openings 126*m* 128 in the example shown in FIGS. 3 and 4 is an oval-shaped opening having straight and parallel side edges extending parallel to the side edges 121*a*, 121*b* of the main body 120 and that are interconnected by rounded ends as shown. The openings 126 and 128 are elongated and arranged in a single line along the longitudinal axis (i.e., along the axial length dimension) of the fuse element 110 wherein the longitudinal centerlines of the oval-shaped openings are aligned on the longitudinal centerline of the main body 120 in the fuse element 110. The longitudinal length of the larger opening 128 (measured in a direction parallel to the longitudinal axis or lengthwise dimension of the fuse element 110) is about twice the longitudinal length of the smaller openings 126, while the radius of the rounded ends of each of the openings 126, 128 is equal.

The main body 120 of the fuse element 110 further includes inwardly curving and arcuate edge sections 130 in the side edges 121*a*, 121*b* that are aligned and centered with respect to each opening 126, 128 on each opposing side of the oval-shaped openings 126 and 128. In between the curved edge sections 130 and the straight side edges of the openings 126 and 128 are respective weak spots of reduced cross-sectional area in the fuse element 110 on each opposing side of the openings 126, 128. By virtue of the reduced cross-sectional area at the weak spots, the fuse element is heated to its greatest extent at the location of the weak spots by current flowing through the fuse element 110. Each opening 126 and 128 and the respective inwardly curving edge sections 130 therefore defines two parallel current paths, one on each side of the respective opening, where the voltage divides and reduces incidence of arc energy in each current path as the fuse element opens at the weak spots. In the example shown, the curved edge sections 130 reduce the cross-sectional area to a minimum amount of cross-sectional area near the midpoint of each curved edge section 130 so this is where the maximum heat is generated and where the fuse element first begins to melt near each of the openings 126, 128. Also, because the opening 128 is larger, the fuse element heats more quickly around the opening 128 than the openings 126 and therefore the fuse element 110 can be expected to open first around the opening 128 followed by the opening of the fuse element 110 around the openings 126 if sufficient arcing occurs.

The radius of each of the curved edges sections 130 in the example shown is the same in the location of each of the openings 126 and 128, and as such the arcuate length of each curved section 130 is the same. While the radius of one or more of the curved sections 130 in the location of each of the openings 126 and 128 could instead be different such that the arcuate length of one or more of the openings would be different, care should be taken to ensure that the cold resistance of the fuse is not negatively impacted. The equal radius of the curved edge sections 130 in the example shown beneficially reduces the cold resistance relative to embodiments wherein the radius of one or more of the curved edges 130 is unequal. Reduction in the cold resistance further affects when the fuse element opens and the incident arc energy at the time that it opens.

Figure 8:
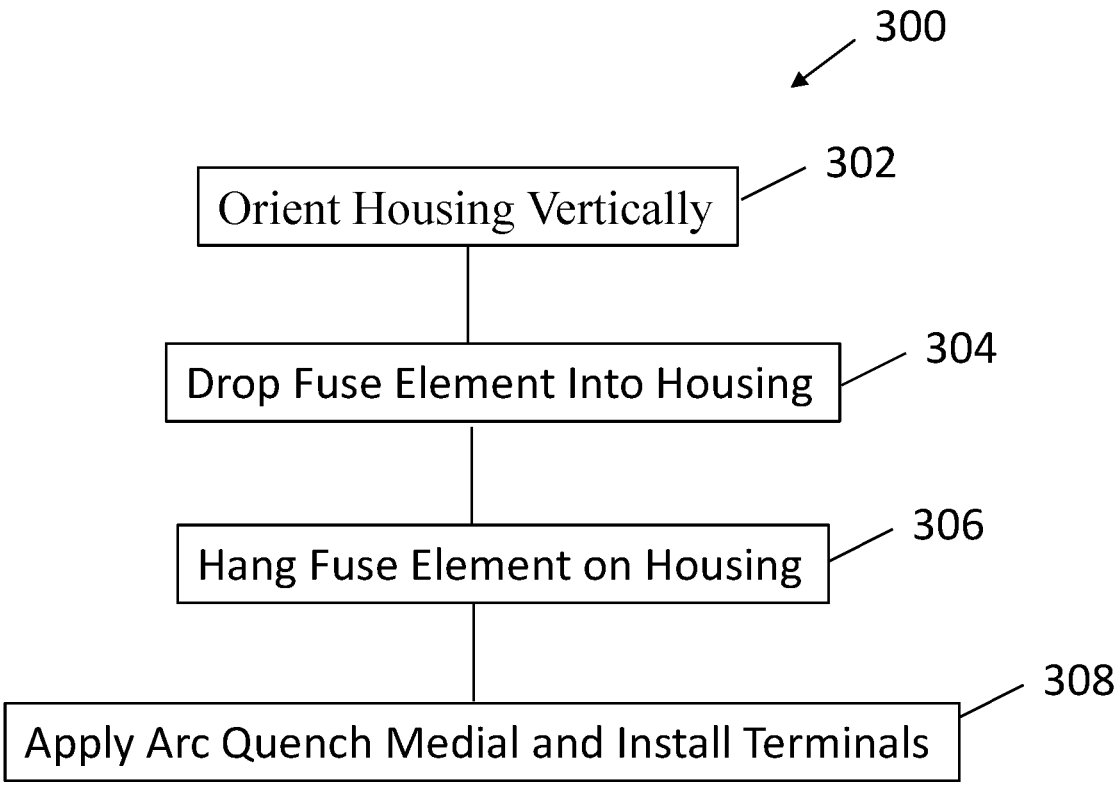
FIG. 8 illustrates a flowchart of an exemplary method for fabricating high voltage cartridge fuse assemblies of the invention.

Referring now to FIG. 8 and the method flowchart 300, in the assembly of the fuse 100 at step 302 the housing 102 is oriented vertically while at step 304 the guide element 122 is dropped down from above and is inserted into the upper end of the housing 102. When the fuse element 110 is fully inserted in the housing 102, at step 306 the tapered side edges 138*a*, 138*b* of the hanger element 124 physically hang on the outside of the upper end of the housing 102 with the guide element 122 extending at the lower end of the fuse housing and centering the main body 120 of the fuse element 110 in the housing 102. At step 308 the solder and end caps 112, 114, 104, 106 can then be installed on each end of the housing 102 in sequence to make the mechanical and electrical connection to the end edges 130, 136 of the fuse element 110 in the completed fuse 100 while surrounding the fuse element 110 with the arc-quenching media 108.

In one embodiment, with the end caps 104, 106 in place, the method may include flowing solder 112, 114 in a thin gap between the respective end caps 104, 106 and the tubular housing 102, and once solidified the solder 112, 114 forms a secure joint between the end caps 104, 106 and the tubular housing 102 to complete the assembly. In another embodiment, however, the end caps 104, 106 including solder 112, 114 may be press fit onto each end of the housing 102 with the fuse element 110 in place to complete the connections to the end caps 104, 106 in the assembly.

The fuse element geometry shown and described for the fuse element 110 is consistent with existing manufacturing equipment and product manufacturing lines to automate the fuse element fabrication and fuse assembly for the cartridge fuse 100. More importantly, and unlike conventional 6×32 mm cartridge fuses, the fuse element geometry shown and described for the fuse element 110 enables a 6×32 mm cartridge fuse having a voltage rating of 500 VDAC, 20 kA IR Rating, 12 A to 30 A current ratings and a defined opening time at 100% rated current. Testing of the cartridge fuse 100 including the fuse element 110 has confirmed a reliable operation of the fuse with the aforementioned ratings in the desired package size of 6×32 mm. It is appreciated, however, that variations of the geometry in the fuse element 110 are possible in different embodiments that may provide comparable results, including but not limited to varying the size, shape and number of the openings in the fuse element 110. In particular, by providing additional openings in the fuse element further arc division can be realized to increase the voltage rating even more.

In another aspect, testing has confirmed that the fuse 100 including the fuse element 110 operates as a current-limiting fuse with further benefit to certain power systems. Specifically, current-limiting tests have been conducted on the fuse element 110 at the lowest power factor (PF) of 0.16 at 500 VAC and 20 kA IR and have been have passed. Such PF of 0.16 is believed to be generally applicable to meet the needs of most commercial power systems. Conventional cartridge fuses of similar size and voltage and IR ratings, however, are not believed have similar current-limiting capability with comparable power factor.

Figure 5:
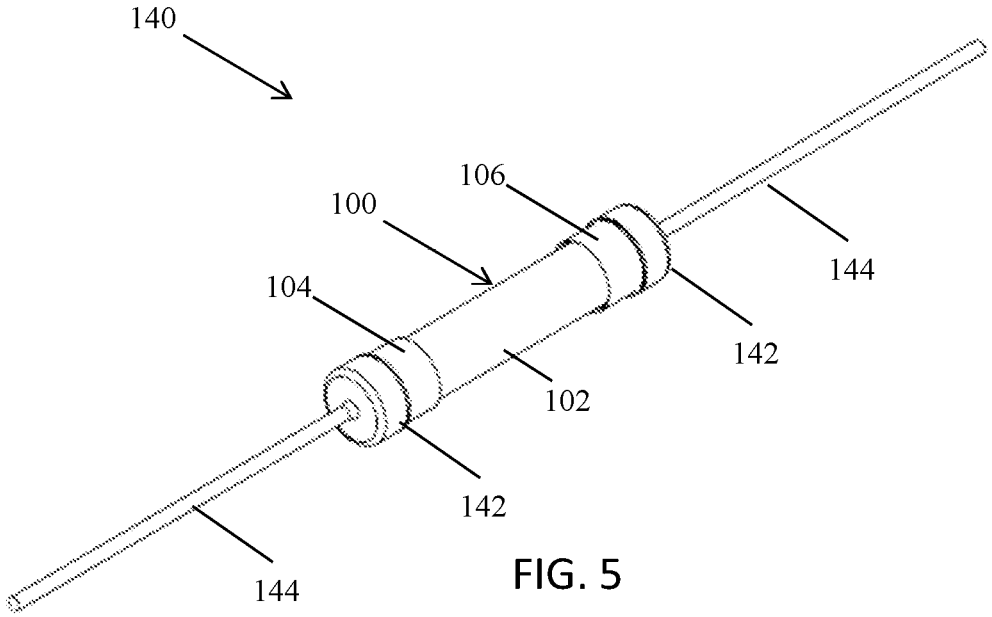
FIG. 5 is a perspective view of an exemplary high voltage cartridge fuse assembly according to a second embodiment of the present invention.

FIG. 5 illustrates another embodiment of a cartridge fuse assembly 140 that is similar to the cartridge fuse assembly 100 but includes leaded cap assemblies 142, 144 coupled to the end caps 104, 106 to establish the line and load-side connections to circuitry in the power system 200. Such leaded cap assemblies may be desired in EV power system applications or in other applications, although it is appreciated that a variety of alternative terminals to establish line and load-side connections are known and could be used instead.

Figure 6:
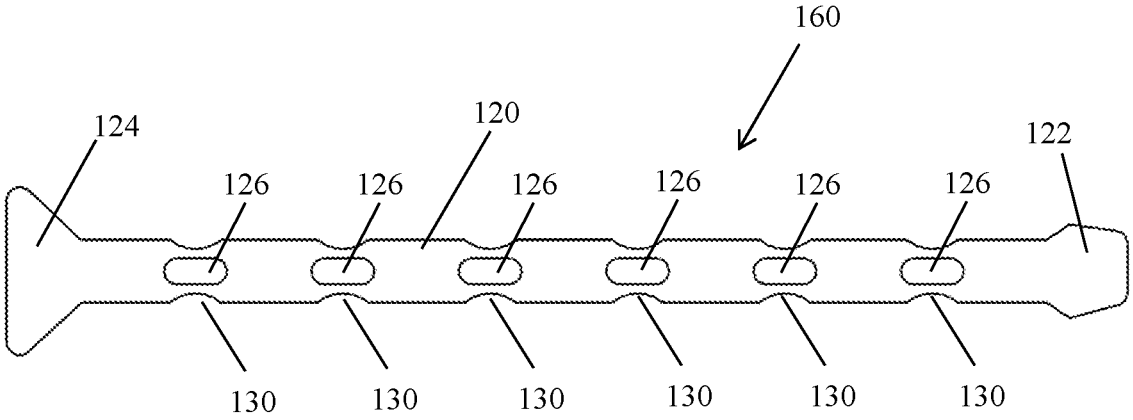
FIG. 6 is a top plan view of an alternative fuse element for the high voltage cartridge fuse assemblies shown in FIGS. 1, 2 and 5.
Figure 7:
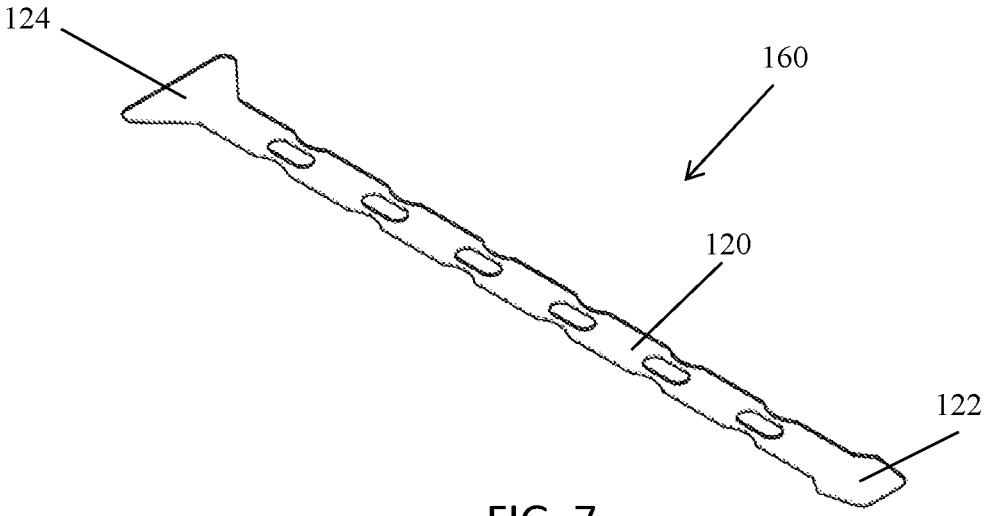
FIG. 7 is a perspective view of the fuse element shown in FIG. 6.

FIGS. 6 and 7 illustrate another fuse element 160 that may be used in lieu of the fuse element 110 in the fuses 100 or 140. Compared to the fuse element 110, the fuse element 160 includes six equally sized, elongated oval shaped openings 126 in the main body 120 while also including the guide element 122 and the hanger element 124 as described above. The fuse element 160 including six openings (as opposed to five openings in the fuse element 110) may beneficially realize a 6×32 mm cartridge fuse assembly having a voltage rating of 600 VDAC, 20 kA IR Rating, 12 A to 30 A current ratings and a defined opening time at 100% rated current. The equal sized openings 126 in the fuse element 160 may also be slightly easier to fabricate than the fuse element 110 including the differently sized openings 126 and 128.

The benefits and advantages of the inventive cartridge fuse is now believed to have been amply demonstrated in the exemplary embodiments disclosed.

An embodiment of an electrical cartridge fuse assembly has been disclosed including a cylindrical housing having an inner diameter less that 6 mm, first and second terminals coupled to opposing ends of the cylindrical housing, and a thin strip fuse element inside the housing and interconnected between the first and second terminals. The fuse element has an axial length of about 32 mm and the fuse element includes an elongated main body having a first width and at least five elongated openings formed therein in a single line along an axial centerline of the elongated main body, a guide element extending on a first end of the main body and including a first flat end having a second width greater than the first width but less than the inner diameter of the cylindrical housing, and a hanger element extending on a second end of the main body opposite the guide element, the hanger element having a second flat end with a third width exceeding the inner diameter of the cylindrical housing. The assembled cartridge fuse has a package size of about 6×32 mm and a voltage rating of at least 500 VADC.

Optionally, the guide element may further include a first pair of opposing sloped side edges extending away from the first flat end and toward the main body, wherein the first pair of opposing sloped edges expands a width of the guide element to a third width greater than the second width. The guide element may also include a second pair of opposing sloped side edges extending away from the first tapered section and toward the main body, wherein the pair of opposing sloped side edges reduces a width of the guide element to the first width. The first pair of opposing sloped side edges may have a relatively shallow slope, and the second pair of opposing sloped side edges may have a relatively steep slope.

As further options, the at least five elongated openings may include at least two elongated openings of unequal length in the main body. The at least five openings may be elongated oval-shaped openings including straight and parallel sides. The main body of the fuse element may further include inwardly curved side-edge sections at the location of each of the five elongated openings. The inwardly curved side edge sections may be formed with an equal radius at each location of the five openings.

As further and alternative options, the main body may include includes six elongated openings, and the fuse may have a voltage rating of 600 VACDC. The six elongated openings may have an equal size, and may further be elongated oval shaped openings. The main body of the fuse element may include inwardly curved side edge sections at the location of each of the six elongated oval shaped openings. The inwardly curved side edge sections are formed with an equal radius at each location of the six elongated oval shaped openings.

The first and second terminals may optionally be end caps. The first and second terminals may likewise include a leaded cap assembly. The housing may be ceramic. The fuse element may be a silver fuse element. The electrical cartridge fuse may be a current limiting fuse having a power factor of 0.16, may have at least a 20 kA IR Rating and a current rating of 12 A to 30 A, and may have a defined opening time at 100% rated current.

An embodiment of an electrical fuse has also been disclosed including a cylindrical housing, first and second terminals coupled to the cylindrical housing, and a fuse element inside the housing and interconnected between the first and second terminals. The fuse element includes a main body having at least five openings formed therein in a single line along a longitudinal axis of the fuse element, a guide element formed on a first end of the main body, and a hanger element formed on a second end of the main body opposite the guide element. The fuse has a package size of about 6×32 mm and a voltage rating of at least 500 VADC (i.e. 500 VAC or 500 VDC), a 20 kA IR Rating, a current rating of 12 A to 30 A and a defined opening time at 100% rated current.

Optionally, the at least five openings includes at least two openings of different size. The at least five openings may be oval-shaped openings including straight and parallel sides. The main body of the fuse element may also include inwardly curved side-edges at the location of each of the five openings, and the inwardly curved side edges may be formed with an equal radius at each location of the five openings. The main body may also include six openings, and the fuse may have a voltage rating of 600 VACDC. The first and second terminals may be end caps, and the fuse may include leaded cap assemblies. The fuse may be a current limiting fuse having a power factor of 0.16.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An electrical cartridge fuse assembly comprising:

a cylindrical housing having an inner diameter less that 6 mm;

first and second terminals coupled to opposing ends of the cylindrical housing; and a thin strip fuse element inside the housing and interconnected between the first and second terminals, the fuse element having an axial length of about 32 mm and the fuse element including:

an elongated main body having a first width and at least five elongated openings formed therein in a single line along an axial centerline of the elongated main body;

a guide element extending on a first end of the main body and including a first flat end having a second width greater than the first width but less than the inner diameter of the cylindrical housing; and a hanger element extending on a second end of the main body opposite the guide element, the hanger element having a second flat end with a third width exceeding the inner diameter of the cylindrical housing;

wherein the assembled cartridge fuse has a package size of about 6×32 mm and a voltage rating of at least 500 VADC.

2. The electrical cartridge fuse assembly of claim 1, wherein the guide element further includes a first pair of opposing sloped side edges extending away from the first flat end and toward the main body, wherein the first pair of opposing sloped edges expands a width of the guide element to a third width greater than the second width.

3. The electrical cartridge fuse assembly of claim 2, wherein the guide element further includes a second pair of opposing sloped side edges extending away from the first tapered section and toward the main body, wherein the pair of opposing sloped side edges reduces a width of the guide element to the first width.

4. The electrical cartridge fuse assembly of claim 3, wherein the first pair of opposing sloped side edges have a relatively shallow slope, and wherein the second pair of opposing sloped side edges have a relatively steep slope.

5. The electrical cartridge fuse assembly of claim 1, wherein the at least five elongated openings includes at least two elongated openings of unequal length in the main body.

6. The electrical cartridge fuse assembly of claim 5, wherein the at least five openings are elongated oval-shaped openings including straight and parallel sides.

7. The electrical cartridge fuse assembly of claim 6, wherein the main body of the fuse element further includes inwardly curved side-edge sections at the location of each of the five elongated openings.

8. The electrical cartridge fuse assembly of claim 7, wherein the inwardly curved side edge sections are formed with an equal radius at each location of the five openings.

9. The electrical cartridge fuse assembly of claim 1, wherein the main body includes six elongated openings, and wherein the fuse has a voltage rating of 600 VACDC.

10. The electrical cartridge fuse assembly of claim 9, wherein the six elongated openings have an equal size.

11. The electrical cartridge fuse assembly of claim 10, wherein the six elongated openings are elongated oval shaped openings.

12. The electrical cartridge fuse assembly of claim 11, wherein the main body of the fuse element further includes inwardly curved side edge sections at the location of each of the six elongated oval shaped openings.

13. The electrical cartridge fuse assembly of claim 12, wherein the inwardly curved side edge sections are formed with an equal radius at each location of the six elongated oval shaped openings.

14. The electrical cartridge fuse assembly of claim 1, wherein the first and second terminals are end caps.

15. The electrical cartridge fuse assembly of claim 1, wherein the first and second terminals comprise a leaded cap assembly.

16. The electrical cartridge fuse assembly of claim 1, wherein the housing is ceramic.

17. The electrical cartridge fuse assembly of claim 1, wherein the fuse element is a silver fuse element.

18. The electrical cartridge fuse assembly of claim 1, wherein the electrical cartridge fuse is a current limiting fuse having a power factor of 0.16.

19. The electrical cartridge fuse assembly of claim 1, wherein the assembled cartridge fuse has at least a 20 kA IR Rating and a current rating of 12 A to 30 A.

20. The electrical cartridge fuse assembly of claim 1, wherein the assembled cartridge fuse has a defined opening time at 100% rated current.

* * * * *